US006766815B2

(12) United States Patent
Zheng

(10) Patent No.: US 6,766,815 B2
(45) **Date of Patent: *Jul. 27, 2004**

(54) COLLAPSIBLE STRUCTURES

(75) Inventor: Yu Zheng, Walnut, CA (US)

(73) Assignee: Patent Category Corp., Walnut, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/912,909

(22) Filed: Jul. 25, 2001

(65) Prior Publication Data

US 2001/0039959 A1 Nov. 15, 2001

Related U.S. Application Data

(63) Continuation of application No. 09/326,817, filed on Jun. 7, 1999, now Pat. No. 6,267,128.

(51) Int. Cl.[7] ..... E04H 15/40

(52) U.S. Cl. ..... 135/143; 135/117; 135/126; 135/128; 446/487; 473/471

(58) Field of Search ..... 135/125, 126, 135/128, 143, 117; 160/370.21; 446/487; 473/471; 296/97.7

(56) References Cited

U.S. PATENT DOCUMENTS 4,632,138 A * 12/1986 Irwin ..... 135/143
4,815,784 A 3/1989 Zheng
5,024,262 A 6/1991 Huang
5,038,812 A 8/1991 Norman
5,213,147 A * 5/1993 Zheng ..... 160/370.21
5,301,705 A * 4/1994 Zheng ..... 135/125
5,439,018 A 8/1995 Tsai
5,560,385 A 10/1996 Zheng
D375,928 S * 11/1996 Wang ..... D12/190
5,592,961 A * 1/1997 Chin ..... 135/125
5,671,479 A * 9/1997 Dedrick ..... 2/46
5,722,446 A * 3/1998 Zheng ..... 135/125
5,732,759 A * 3/1998 Wang ..... 160/370.21
5,778,915 A 7/1998 Zheng
5,800,067 A 9/1998 Easter
5,816,954 A 10/1998 Zheng
6,109,281 A * 8/2000 Lowenthal ..... 135/143 X
6,155,329 A * 12/2000 Hwang et al. ..... 160/370.21

* cited by examiner

*Primary Examiner*—Winnie Yip
(74) *Attorney, Agent, or Firm*—Raymond Sun

(57) ABSTRACT

A collapsible structure has a first panel and a second panel, each panel having a foldable frame member having a folded and an unfolded orientation, with a fabric material covering portions of the frame member to form the panel when the frame member is in the unfolded orientation. The first panel has a first side that is stitched to the fabric of the second panel by a stitching. Another collapsible structure has a first panel and a second panel, each panel having a foldable frame member having a folded and an unfolded orientation, with a fabric material covering portions of the frame member to form the panel when the frame member is in the unfolded orientation. The second panel has an opening provided in its fabric, with a first side of the first panel inserted through the opening to couple the first panel to the second panel.

7 Claims, 11 Drawing Sheets

COLLAPSIBLE STRUCTURES

RELATED APPLICATIONS

The present application is a continuation of Ser. No. 09/326,817, filed Jun. 7, 1999, for "Collapsible Structures", now U.S. Pat. No. 6,267,128.

BACKGROUND OF THE INVENTION

1. Field of the Invention

The present invention relates to collapsible structures, and in particular, to collapsible structures which may be provided in a variety of shapes and sizes. The collapsible structures may be twisted and folded to reduce the overall size of the play structures to facilitate convenient storage and use.

2. Description of the Prior Art

Collapsible objects have recently become popular with both adults and children. Many of these collapsible objects have a plurality of panels which may be twisted and folded to reduce the overall size of the object to facilitate convenient storage and use. Each panel is comprised of a fabric or material that is supported by a resilient frame member, with the fabric or material spanning a portion of, or entirely across, the area supported by the frame member. The frame member supports the periphery of each panel, and is capable of being twisted and folded to reduce the size of each panel.

Examples of such collapsible objects are shown and described in U.S. Pat. No. 5,467,794 (Zheng), U.S. Pat. No. 5,560,385 (Zheng) and U.S. Pat. No. 5,778,915 (Zheng) in the form of collapsible structures. These structures are currently being enjoyed by many people in many different applications. For example, these structures have been provided in many different shapes and sizes for children's play indoors and outdoors. Smaller versions of these structures have been used as infant nurseries. Even smaller versions of these structures have been used as dollhouses and action figure play houses by toddlers and children. As another example, these structures have been made into tents or outdoor structures that can be used by adults and children for camping or other outdoor purposes. These structures have also been used as beach cabanas. Even animals can enjoy these structures. Some of these structures have been made into shelters that can be used by pets, both indoors and outdoors.

The wide-ranging uses for these collapsible structures can be attributed to the performance, convenience and variety that these structures provide. When fully expanded, these structures are stable and can be used as a true shelter without the fear of collapse. These structures are easily twisted and folded into a compact configuration to allow the user to conveniently store the structures. The light-weight nature of the materials used to make these structures makes it convenient for them to be moved from one location to another. These structures also provide much variety in use and enjoyment. For example, a child can use a structure both indoors and outdoors for different play purposes, and can use the same structure for camping.

Another example of collapsible objects includes collapsible game and play structures, such as those illustrated in U.S. Pat. No. 5,722,446 (Zheng) and U.S. Pat. No. 5,816,954 (Zheng). These structures provide a multitude of game structures that can be enjoyed by children and adults indoors and outdoors.

SUMMARY OF THE DISCLOSURE

It is an object of the present invention to provide collapsible objects and structures that are different from those mentioned above, which offer the user different variety of play and flexibility in use.

In order to accomplish the objects of the present invention, one collapsible structure according to the present invention has a first panel and a second panel, each panel having a foldable frame member having a folded and an unfolded orientation, with a fabric material covering portions of the frame member to form the panel when the frame member is in the unfolded orientation. The first panel has a first side that is stitched to the fabric of the second panel by a stitching.

Another collapsible structure according to the present invention has a first panel and a second panel, each panel having a foldable frame member having a folded and an unfolded orientation, with a fabric material covering portions of the frame member to form the panel when the frame member is in the unfolded orientation. The second panel has an opening provided in its fabric, with a first side of the first panel inserted through the opening to couple the first panel to the second panel.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

The present invention illustrates basic principles that can be utilized for coupling adjacent panels of a collapsible structure. Although the present disclosure illustrates certain structural configurations in which these coupling principles are embodied, it will be appreciated by those skilled in the art that the underlying principles of the present invention can be applied to collapsible structures having different shapes and sizes, and incorporating different numbers and arrangements of panels.

Figure 1:
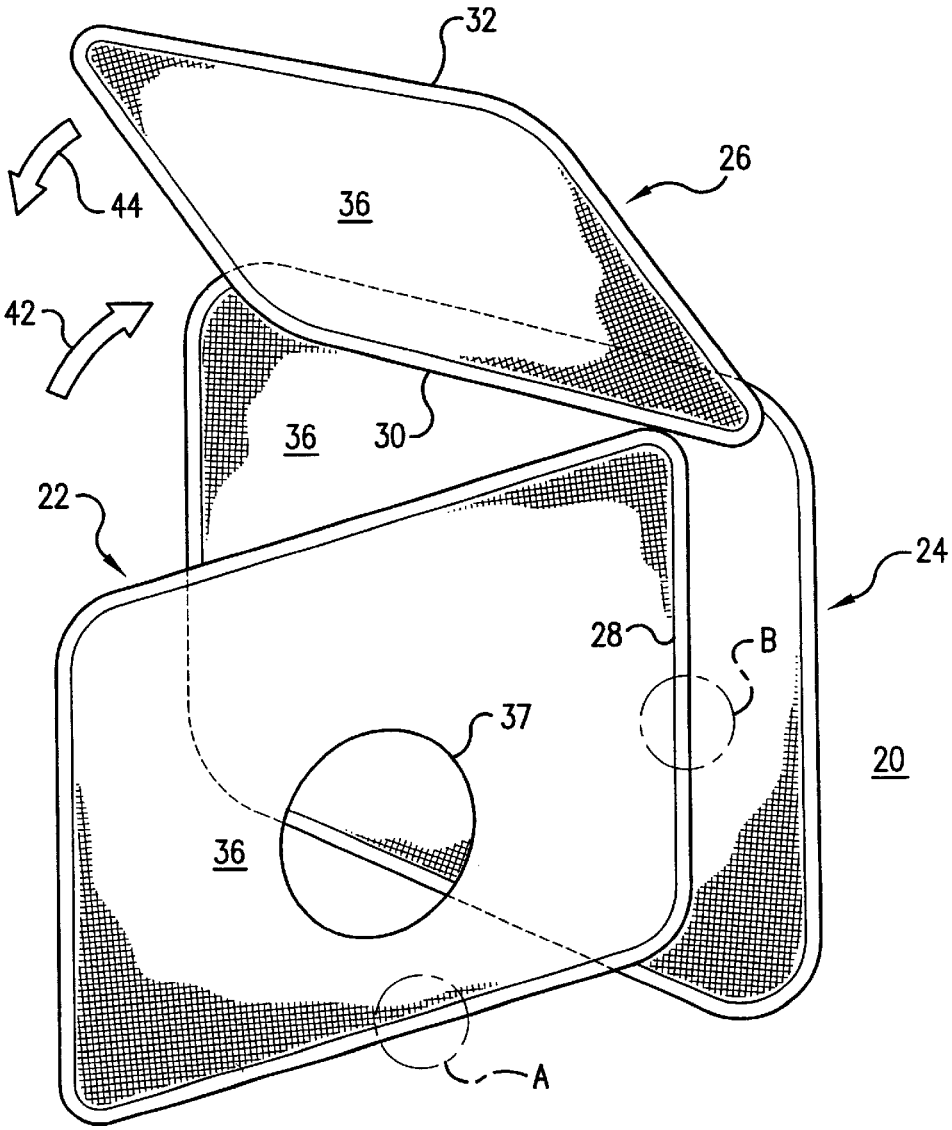
FIG. 1 is a perspective view of a collapsible structure according to one embodiment of the present invention.

According to a first embodiment of the present invention, a side of a panel is stitched to the fabric of an adjacent panel to hingedly attach the two adjacent panels together. The basic principles for this embodiment are illustrated in FIG. 1, where the structure 20 has three panels 22, 24 and 26 that are connected to each other. The three panels include a first side panel 22 and a second side panel 24 that are hingedly connected together to form a corner, and a top panel 26 that is hingedly connected to the second side panel 24. The first side panel 22 has a side 28 that is hingedly connected to the second side panel 24 in the manner described below, and the top panel 26 has a side 30 that is also hingedly connected to the second side panel 24 in the manner described below. In the structure 20, each of the panels 22, 24, 26 is illustrated as having four sides, although this merely for illustrative purposes and each panel can have any number of sides and can assume any shape and size. The structure 20 shown in FIG. 1 can be used as a partition, among other possible uses.

Figure 2:
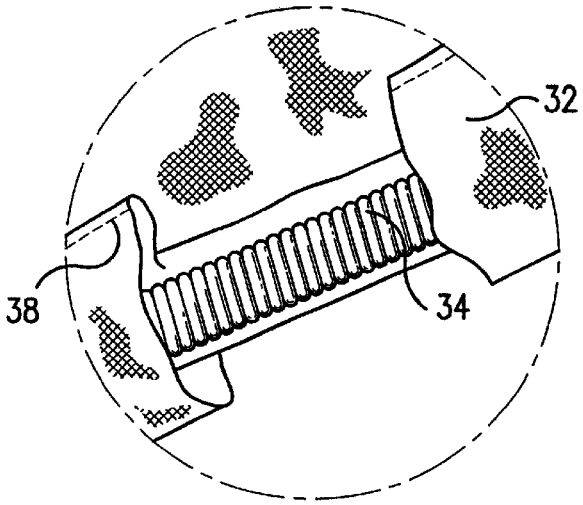
FIG. 2 is a partial cut-away view of the section A of the structure of FIG. 1 illustrating a frame member retained within a sleeve.

Each panel 22, 24, 26 has a continuous frame retaining sleeve 32 provided along and traversing the edges of all of its sides. As shown in FIG. 2, each sleeve 32 may be formed by folding a piece of fabric and applying a stitching 38 to enclose the sleeve. A continuous frame member 34 is retained or held within each frame retaining sleeve 32 to support each panel 22, 24, 26. Only one frame member 34 is shown in FIG. 2; the other frame members are not shown but are the same as frame member 34. The continuous frame members 34 may be provided in the form of one continuous loop, or may comprise a strip of material connected at both ends to form a continuous loop. The continuous frame members 34 are preferably formed of flexible coilable steel having a memory, although other materials such as plastics may also be used. The frame members 34 should be made of a material which is relatively strong and yet is flexible to a sufficient degree to allow it to be coiled. Thus, each frame member 34 is capable of assuming two positions or orientations, an open or expanded position such as shown in FIG. 1 in connection with a corresponding panel, or a folded position in which the frame member 34 is collapsed into a size which is much smaller than its open position (see FIG. 5E in connection with a corresponding panel).

Fabric or sheet material 36 extends across each panel 22, 24, 26 and is held taut by the respective frame member 34 when in its open position. The fabric 36 for a particular panel 22, 24 or 26 is stitched to its corresponding frame retaining sleeve 32. The fabric 36 can extend completely across the panel to entirely cover the space enclosed by the frame member 34, or can extend across selected portions of the space enclosed by the frame member 34. For example, the fabric 36 of panel 22 has an opening 37, so that the fabric 36 does not extend across the entire space enclosed by the frame member 34. The term fabric is to be given its broadest meaning and should be made from strong, lightweight materials and may include woven fabrics, sheet fabrics or even films and meshed materials. The fabric should be water-resistant and durable to withstand the wear and tear associated with rough treatment by children. The frame members 34 may be merely retained within the respective frame retaining sleeves 32, without being connected thereto. Alternatively, the frame retaining sleeves 32 may be mechanically fastened, stitched, fused, or glued to the frame members 34 to retain them in position.

Figure 3:
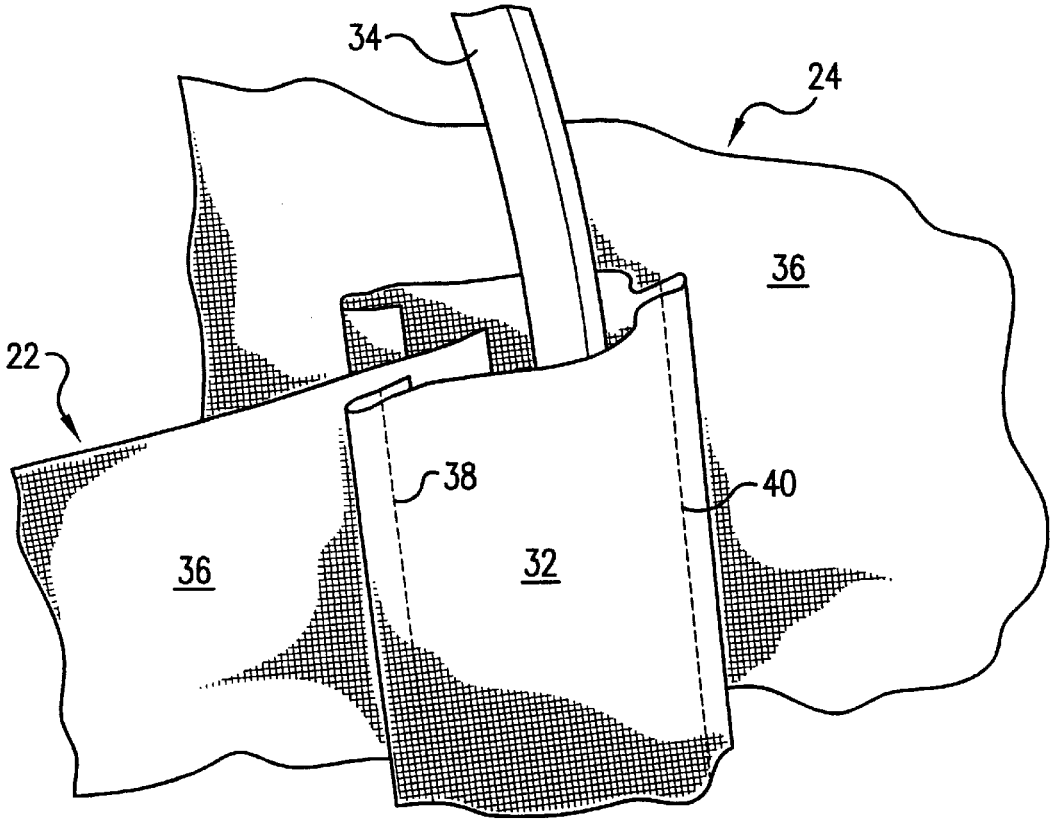
FIG. 3 is an expanded view of the section B of the structure of FIG. 1 illustrating the connection between two adjacent panels.

FIG. 3 illustrates how the side 28 of the panel 22 is hingedly connected to the panel 24. The sleeve 32 of the panel 22 is stitched directly to the fabric 36 of the panel 24 by a stitching 40 at any desired location of the fabric 36 on the panel 24. The stitching 40 can extend along the entire side 28. The stitching 40 also acts as a hinge for the panels 22 and 24 to be folded upon each other, as explained below. The side 30 of the top panel 26 can be hingedly connected to the fabric 36 of the panel 24 in the same way.

The panels 22, 24, 26 may be folded and collapsed to reduce the overall size of the panels for storage. The panel 22 is first folded towards the panel 24 in the direction of arrow 42, and the panel 26 is folded towards panels 22, 24 in the direction of arrow 44, so as to form a stack of three panels 26, 22, 24 (in one possible order) which can be twisted and collapsed using the techniques and principles described in connection with FIGS. 5C–5E below.

Figure 4:
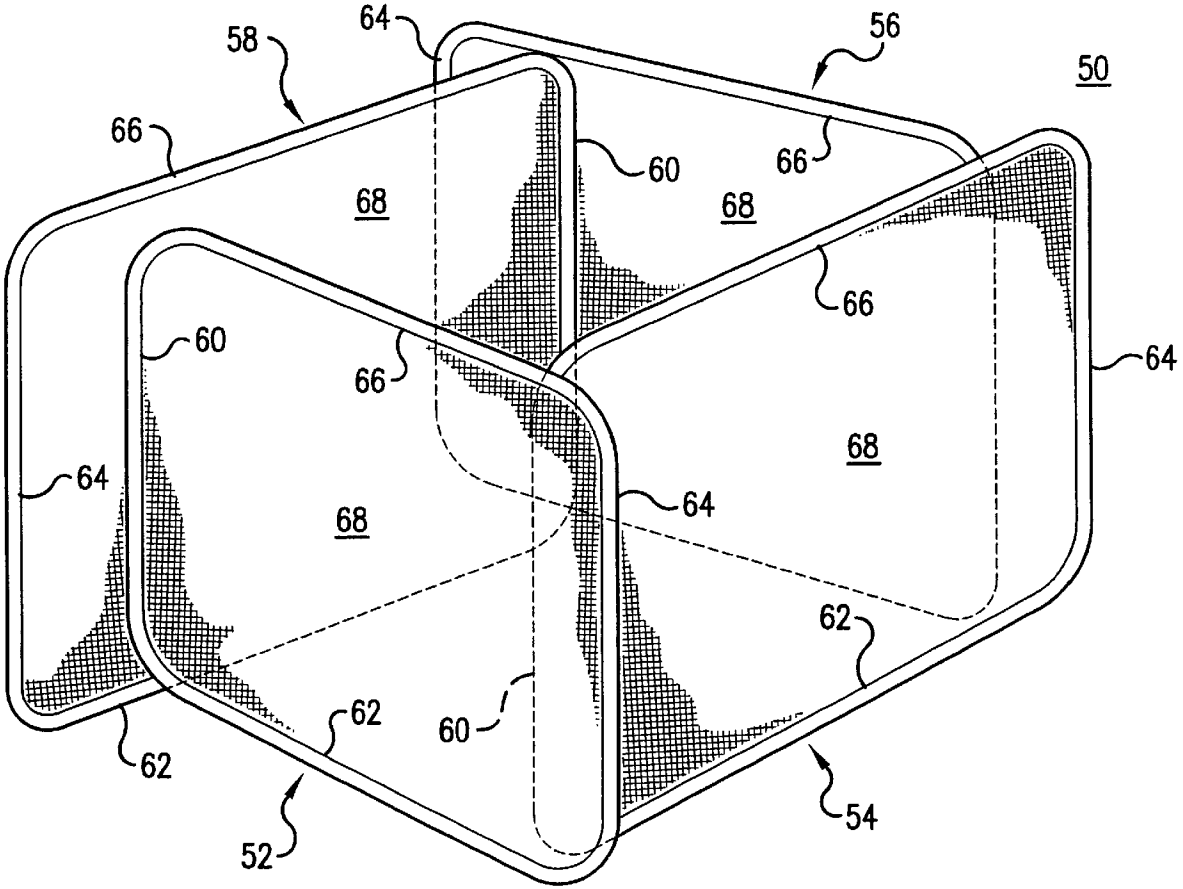
FIG. 4 is a perspective view of a collapsible structure according to another embodiment of the present invention.

FIG. 4 illustrates another structure 50 having its panels hingedly connected according to the principles illustrated in FIGS. 1–3. Structure 50 has four panels 52, 54, 56 and 58 connected to each other to encircle an enclosed space. Each panel 52, 54, 56 and 58 has four sides, including a first side 60, a second side 62, a third side 64 and a fourth side 66. The first side 60 of each panel is hingedly connected to the fabric 68 of an adjacent panel to form the structure 50. The hinged connections of the first sides 60 to the fabrics 68 can be the same as that illustrated in FIG. 3 above. Again, even though each of the panels 52, 54, 56, 58 is illustrated as having four sides, this is merely for illustrative purposes only and each panel can have any number of sides and can assume any shape and size. As a non-limiting example, the structure 50 shown in FIG. 4 can be used as a partition or play structure, and if a roof fabric (not shown) is attached to the top sides of the panels 60, 62, 64, 66, can be used as a tent, shelter, cabana or similar structure.

Figure 5A:
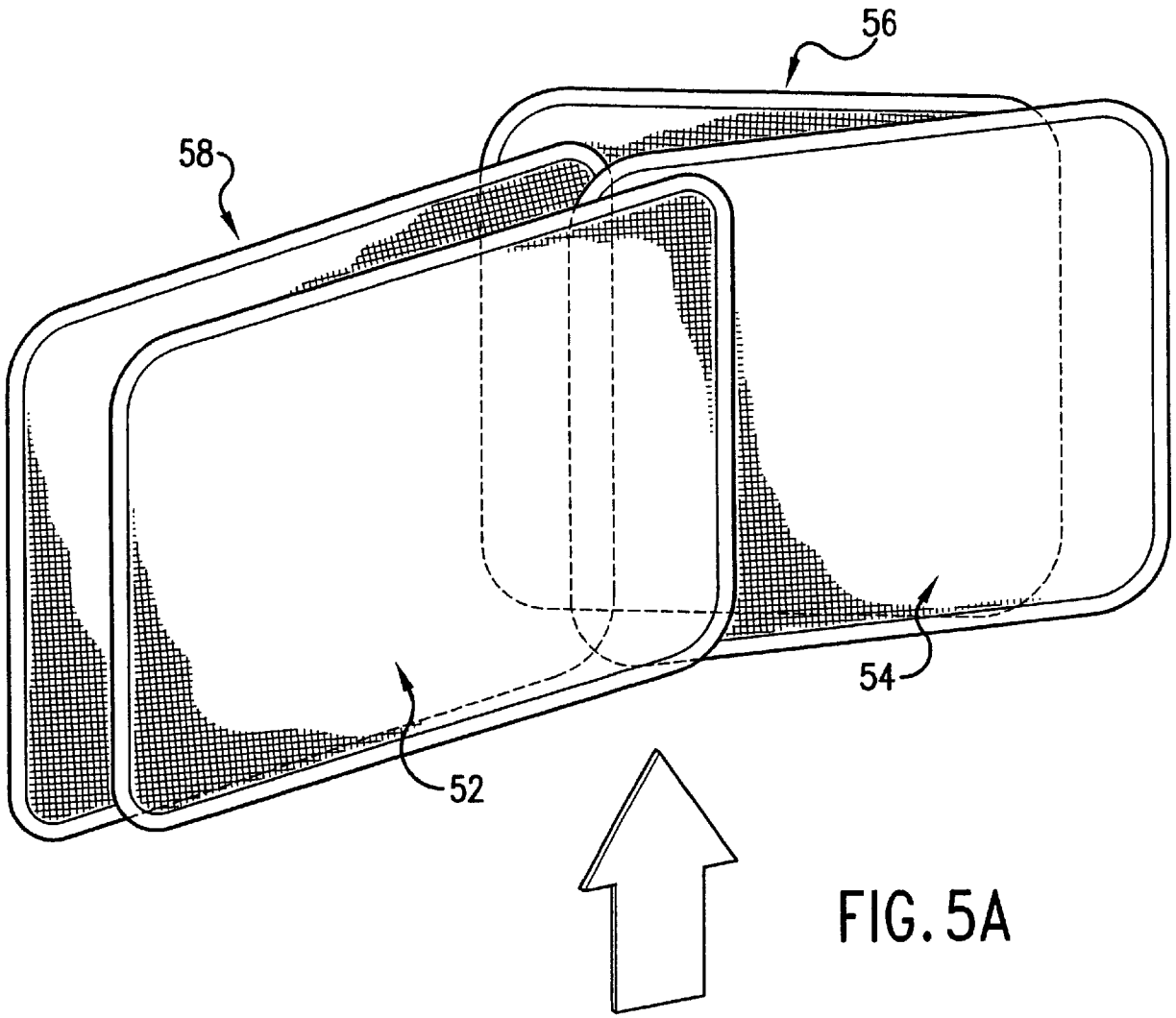
FIGS. 5A through 5E illustrate how the collapsible structure of FIG. 4 may be twisted and folded for compact storage.
Figure 5B:
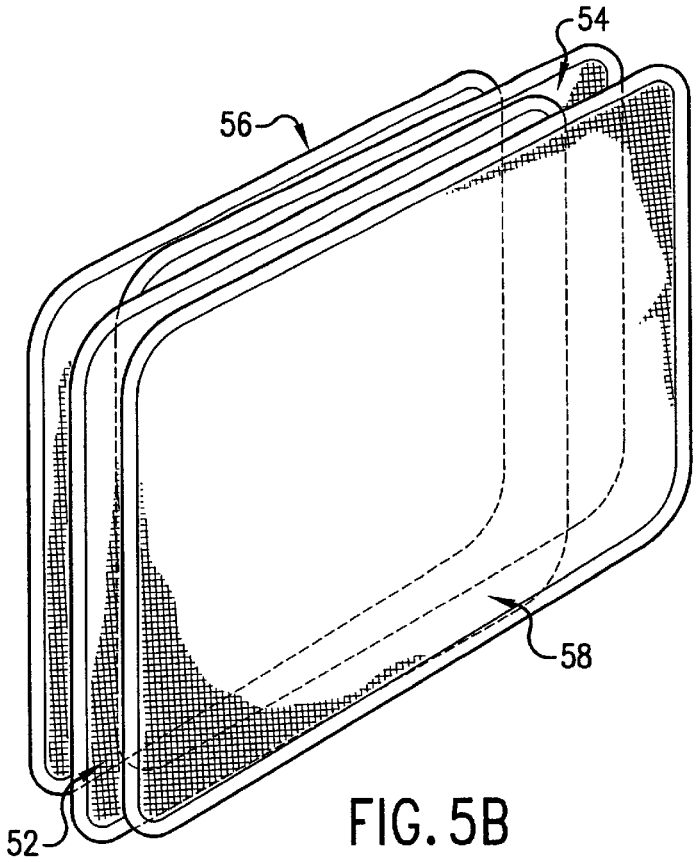
Figure 5C:
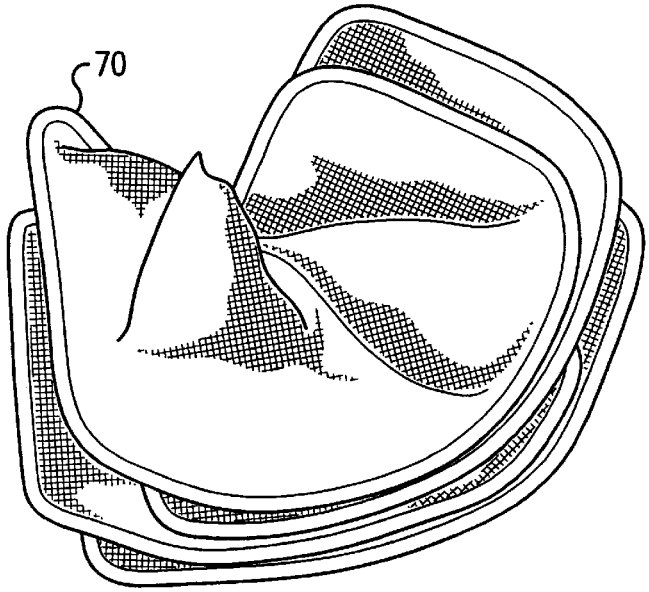
Figure 5D:
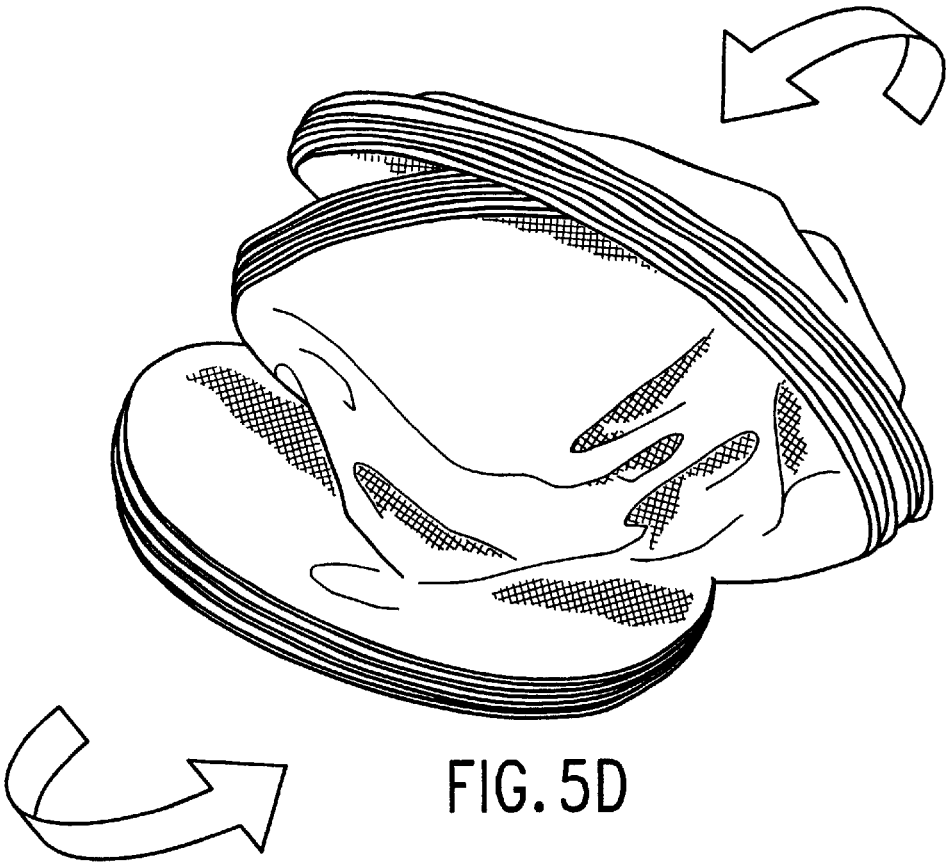
Figure 5E:
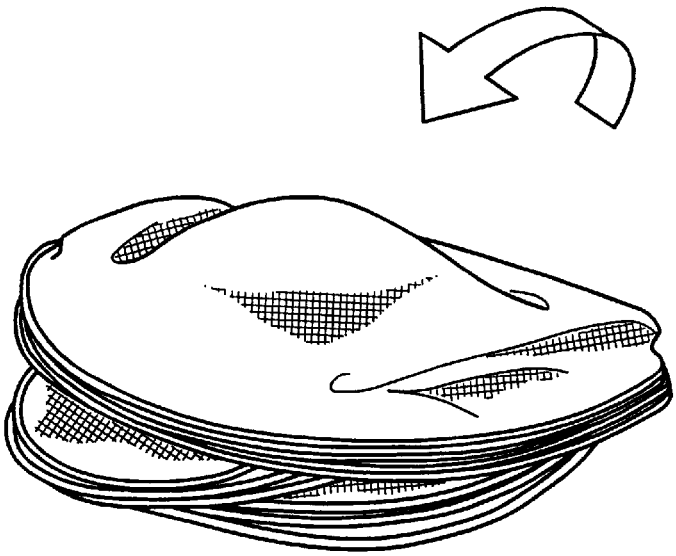

FIGS. 5A through 5E describe the various steps for folding and collapsing the structure 50 of FIG. 4 for storage. As shown in FIG. 5A, the first step consists of pushing in panels 52 and 54 about the hinged connections such that they collapse against panels 58 and 56, respectively. Then, two panels 52 and 58 are folded about the hinged connections so as to be collapsed upon the other two panels 54 and 56 to form a stack of four panels 58, 52, 54, 56 (in one possible order), as shown in FIG. 5B. The stack of panels is then twisted and folded to collapse the frame members and panels into a smaller shape. In the third step shown in FIG. 5C, the opposite border 70 of the stack of panels is folded in upon the previous fold to further collapse the frame members with the panels. As shown in FIG. 5D, the fourth step is to continue the collapsing so that the initial size of the panels are reduced. FIG. 5E shows the fifth step with the frame members and panels collapsed on each other to provide for a small essentially compact configuration having a plurality of concentric frame members and layers of the panels so that the collapsed structure 50 has a size which is a fraction of the initial size of each of the panels.

To re-open the structure 50 to its expanded configuration, the combined stack of panels is unfolded. The memory (i.e., spring-load) of the frame members 34 will cause the frame members 34 to uncoil on their own and to quickly expand the panels to their expanded configuration shown in FIG. 5B. The same principle can be applied to re-open all the other embodiments of the present invention.

Figure 6:
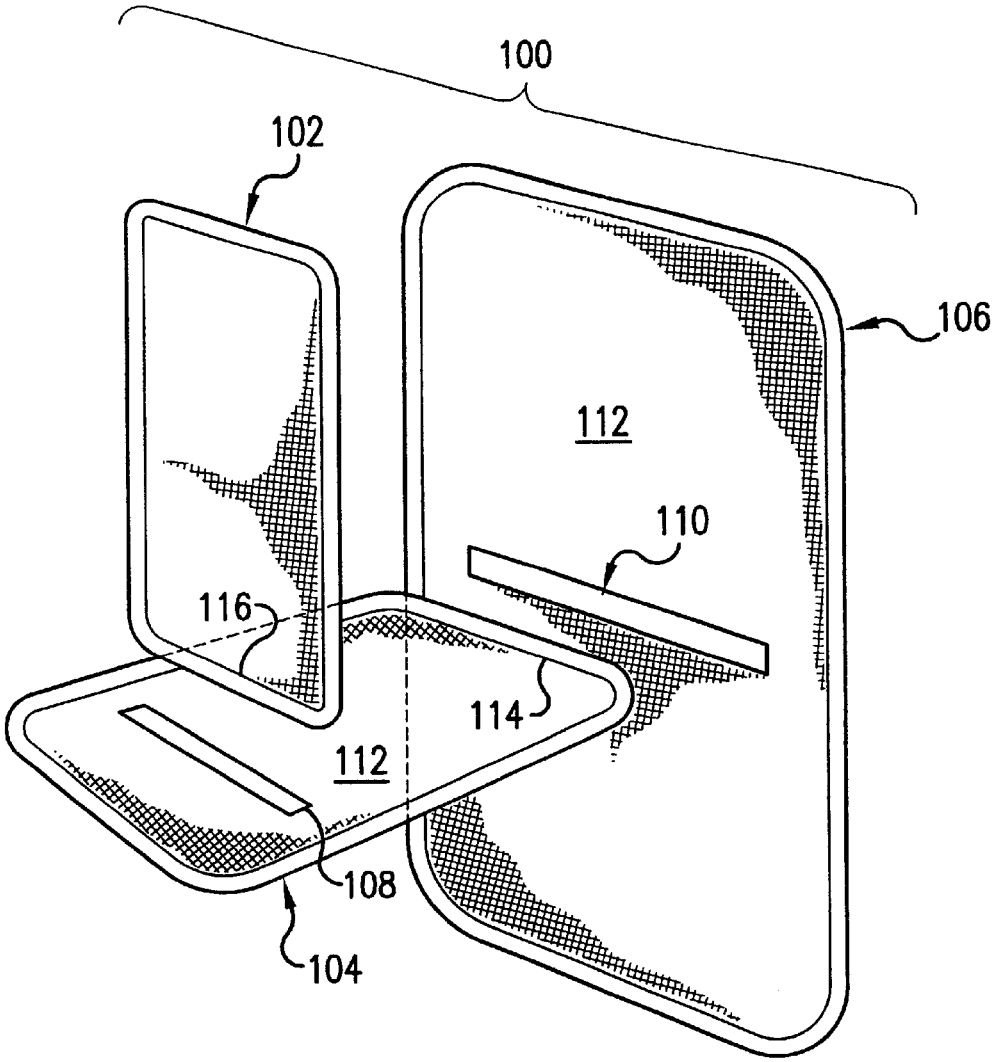
FIG. 6 is an exploded perspective view of a collapsible structure according to yet another embodiment of the present invention.
Figure 7:
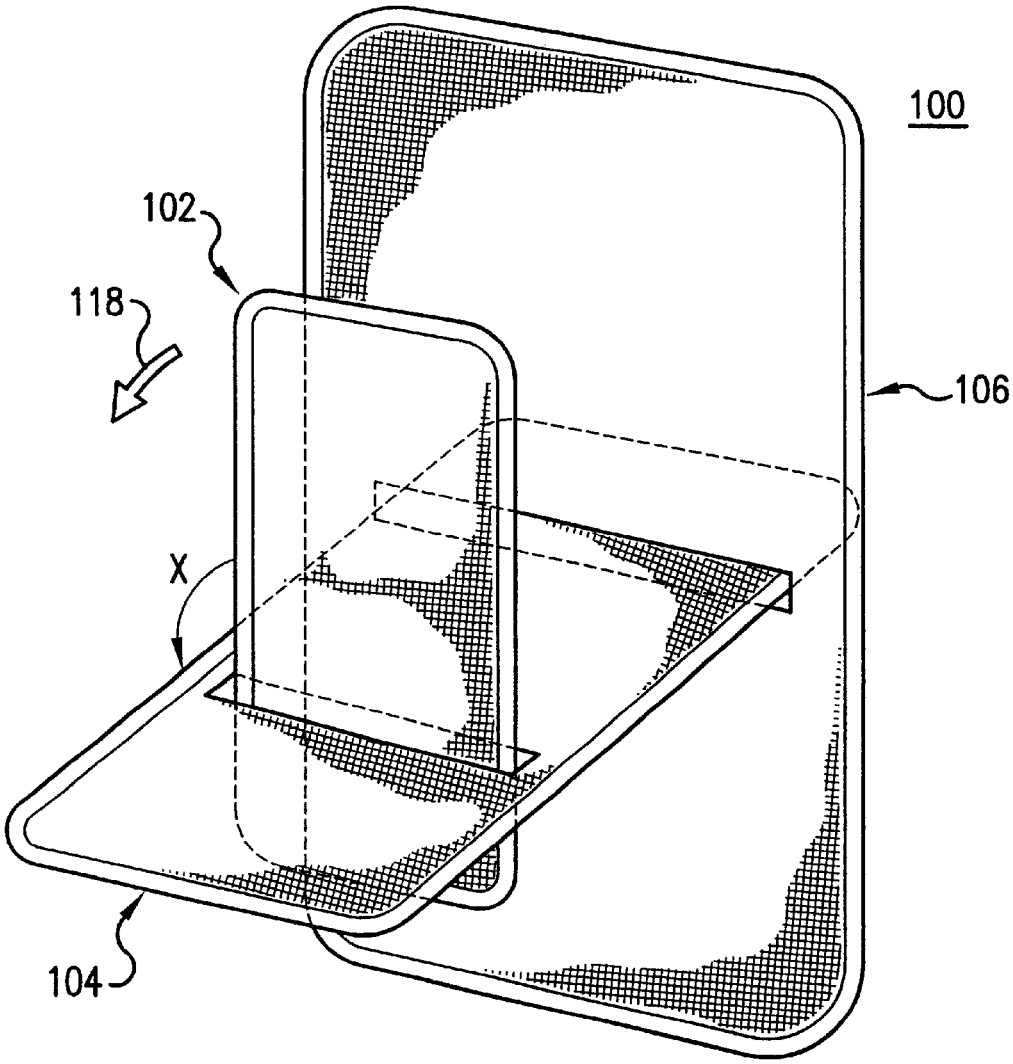
FIG. 7 is a perspective view of the structure of FIG. 6.

According to a second embodiment of the present invention, the fabric of a panel is provided with one or more elongated openings through which another panel can be passed to effectuate a removable connection between the two panels. The basic principles for this embodiment are illustrated in FIGS. 6 and 7, where the structure 100 has three separate panels 102, 104 and 106 that are connected to each other. Each of the panels 102, 104, 106 can have the same construction as panels 22, 24, 26 described above, except for the differences noted hereinbelow. For example, each panel 104 and 106 has an elongated opening 108 and 110, respectively, provided at any location, and in any desired orientation, on the fabric 112 of the panels 104, 106. One side 114 of the panel 104 can be inserted through the opening 110 of the panel 106 to effectuate a joint or connection between the panels 104 and 106. In a similar manner, a side 116 of the panel 102 can be inserted through the opening 108 of the panel 104 to effectuate a joint or connection between the panels 102 and 104. The panels 102 and 104 can be inserted as far through the openings 108 and 110, respectively, as desired to create the desired resulting configuration of the structure 100. In addition, either panel of a joint can be pivoted with respect to the other panel to vary the angle between the two adjacent panels. For example, the panel 102 is shown in FIG. 7 as being generally perpendicular to (i.e., at about 90 degrees with respect to) the panel 104, and generally parallel with the panel 106. However, the panel 102 can be pivoted in the direction of arrow 118 to change the orientation between the two panels 102 and 104, and to change the angle X between the two panels 102 and 104. This will also change the orientation between panels 102 and 106. Any of the three panels 102, 104, 106 can be pivoted in any direction to change the resulting configuration of the structure 100.

Figure 8:
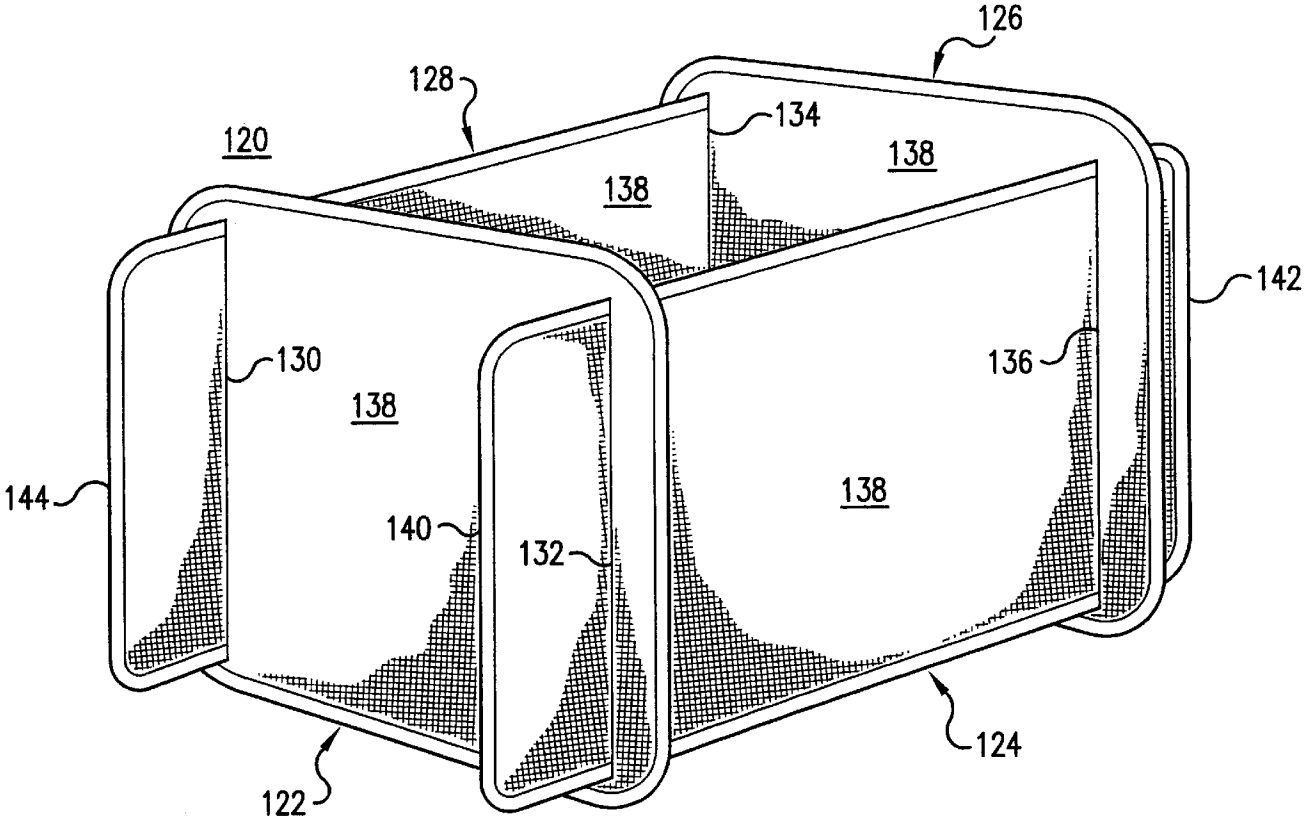
FIG. 8 is a perspective view of a collapsible structure according to a further embodiment of the present invention.

FIG. 8 illustrates another structure 120 that has four separate panels 122, 124, 126 and 128 that are connected to each other. Each of the panels 122, 124, 126, 128 can have the same construction as panels 22, 24, 26 described in FIG. 1 above, except for the differences noted hereinbelow. For example, the panel 122 has two elongated openings 130 and 132, and the panel 126 has two elongated openings 134 and 136. The elongated openings 130, 132, 134, 136 can be provided at any location, and in any desired orientation, on the fabric 138 of the panels 104, 106, although in this embodiment, the openings 130 and 134 should be aligned, and the openings 132 and 136 should be aligned. The alignment of these opening pairs 130, 134 and 132, 136 facilitates the insertion of opposing sides of the other two panels 124, 128 through the aligned openings. For example, one side 140 of the panel 124 can be inserted through the opening 132 of the panel 122 to effectuate a joint or connection between the panels 122 and 124, and the opposing side 142 of the panel 124 can be inserted through the opening 136 of the panel 126 to effectuate a joint or connection between the panels 124 and 126. Similarly, one side 144 of the panel 128 can be inserted through the opening 130 of the panel 122 to effectuate a joint or connection between the panels 122 and 128, and the opposing side (not shown) of the panel 128 can be inserted through the opening 134 of the panel 126 to effectuate a joint or connection between the panels 126 and 128. The panels 124 and 128 can be inserted as far through any of the openings 130, 132, 134, 136 as desired to create the desired resulting configuration of the structure 120, and to vary the size of the enclosed space formed by the four panels 122, 124, 126, 128. Thus, when assembled, the four panels 122, 124, 126, 128 define an enclosed space, with two parallel panels 122 and 126 having elongated openings through which the other parallel panels 124 and 128 may be extended and supported.

The structure 120 can be folded and collapsed for storage using the principles illustrated in FIGS. 5C–5E. In the first step, all the panels of the structure are separated by removing the panels 124 and 128 from the elongated openings 130, 132, 134, 136. Then, the four panels 122, 124, 126, 128 are placed on top of each other to form a stack of four panels. The combined stack of panels is then twisted and folded in the manner shown in FIGS. 5C–5E so that the collapsed structure 120 has a size which is a fraction of the initial size of the structure 120.

In the structures 100 and 120, even though each of the panels 102, 104, 106, 122, 124, 126 and 128 is illustrated as having four sides, this is merely for illustrative purposes and each panel can have any number of sides and can assume any shape and size.

Figure 10:
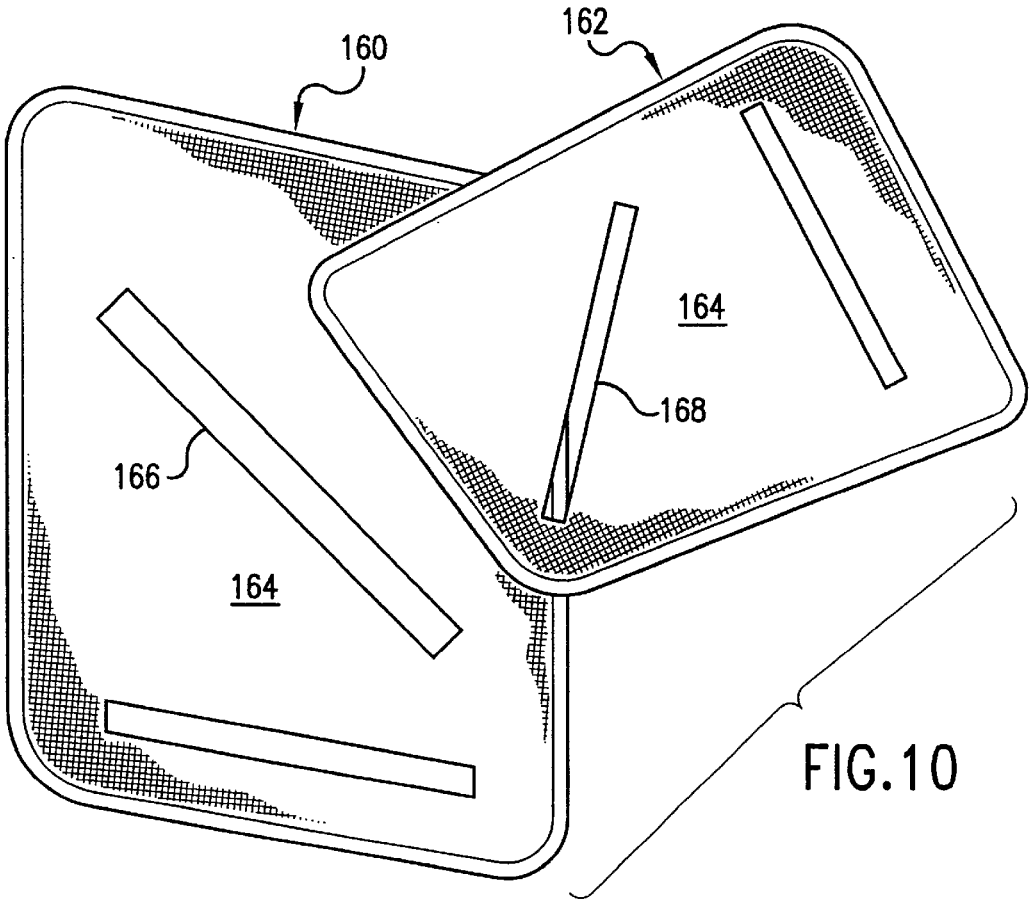
FIG. 10 is a perspective view of a collapsible structure according to yet a further embodiment of the present invention.

The principles illustrated in FIGS. 6–8 provide for the easy assembly and disassembly of the structures, and provide the user with the flexibility to create different configurations. For example, the configurations shown in FIGS. 7 and 8 can be conveniently and quickly assembled by inserting certain panels through elongated openings in other panels. To disassemble these structures 100, 120, the panels can be quickly and conveniently removed and separated, and stacked for folding and collapsing. In addition, a variety of panels having different shapes and sizes can be provided and sold in a package, so that the user can create a structure having as many different panels, each panel having any desired shape and/or size, as desired. In this regard, although the panels 102, 124 and 128 in FIGS. 6–8 are shown as having no elongated openings, it is possible to provide all the panels with elongated openings (such as illustrated in FIG. 10 below) so that the user can use any panel he or she wishes in the creation and assembly of a structure having a configuration of his or her choice. As a result, the principles of the present invention can be used to provide a wide variety of structures, including but not limited to play structures, tents, shelters, partitions, cabanas, and containers.

Another benefit provided by the principles of FIGS. 6–8 is that the joints created by inserting a panel through an elongated opening in an adjacent panel can be rather stable even though these joints are removable. For example, the structure 120 in FIG. 8 is very stable because each panel is supported (albeit in a removable manner) at opposing ends or sides by an adjacent panel.

Figure 9:
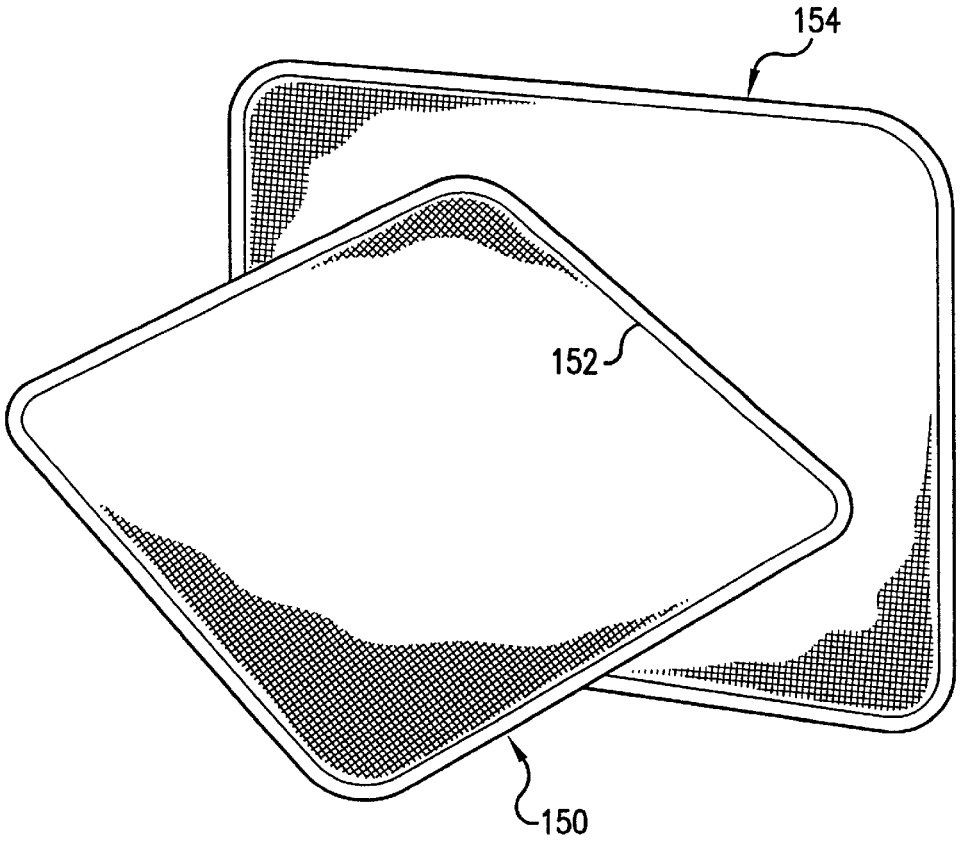
FIG. 9 is a perspective view of a collapsible structure according to yet another embodiment of the present invention.

In addition, although all the connections in FIGS. 1–8 are illustrated as being generally perpendicular or parallel to one or more sides of the panels, it is also possible to provide the connections at almost any angle with respect to the sides of the panels. For example, FIG. 9 illustrates a panel 150 having a side 152 that is coupled to another panel 154 an angle with respect to the sides of the panel 154, using the hinged connection shown in FIG. 3. As another example, FIG. 10 illustrates two panels 160 and 162, each having elongated openings in their fabrics 164 that are angled with respect to the sides of these panels 160, 162. For example, elongated opening 166 is positioned at an angle with respect to the sides of the panel 160, and elongated opening 168 is positioned at an angle with respect to the sides of the panel 162.

Thus, the embodiments of the present invention increase the applications and use of the collapsible structures to provide the user with an unlimited source and variety of fun and entertainment. The shapes and sizes of the panels and the structures can be varied or combined, as well as the entertainment features.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A collapsible structure, comprising:

a first panel having a foldable frame member having a folded and an unfolded orientation, with a fabric material covering portions of the frame member to form the first panel when the frame member is in the unfolded orientation, and with the frame member collapsible to the folded position by twisting and folding to form a plurality of concentric rings; and a second panel having a foldable frame member having a folded and an unfolded orientation, with a fabric material covering portions of the frame member of the second panel to form the second panel when the frame member of the second panel is in the unfolded orientation;

the first panel further including a first side having an edge that is connected to the fabric material of the second panel; and wherein the second panel has a first side, and wherein first side of the first panel is stitched to the fabric of the second panel at an angle with respect to first side of the second panel.

2. The structure of claim 1, wherein the fabric material for each panel extends across the entire panel.

3. The structure of claim 1, wherein each panel further includes a frame retaining sleeve that retains the frame member for the respective panel, with the fabric material for each panel stitched to the respective frame retaining sleeve.

4. A collapsible structure, comprising:

a first panel having a foldable frame member having a folded and an unfolded orientation, with a fabric material covering portions of the frame member to form the first panel when the frame member is in the unfolded orientation, and with the frame member collapsible to the folded position by twisting and folding to form a plurality of concentric rings; and a second panel having a foldable frame member that defines an outer periphery for the second panel, the frame member of the second panel having a folded and an unfolded orientation, with a fabric material covering portions of the frame member of the second panel to form the second panel when the frame member of the second panel is in the unfolded orientation;

the first panel further including a first side having an edge that is stitched to the fabric material of the second panel at a location internal to the outer periphery of the second panel.

5. The structure of claim 4, wherein the fabric material for each panel extends across the entire panel.

6. The structure of claim 4, wherein each panel further includes a frame retaining sleeve that retains the frame member for the respective panel, with the fabric material for each panel stitched to the respective frame retaining sleeve.

7. The structure of claim 4, wherein the second panel has a first side, and wherein first side of the first panel is stitched to the fabric material of the second panel at an angle with respect to first side of the second panel.

* * * * *